US006625293B1

(12) United States Patent
Nageno et al.

(10) Patent No.: US 6,625,293 B1
(45) Date of Patent: Sep. 23, 2003

(54) MICROPHONE

(75) Inventors: Koji Nageno, Tokyo (JP); Naoaki Matsumoto, Chiba (JP)

(73) Assignee: Sony Corporation, Tokyo (JP)

( * ) Notice: Subject to any disclaimer, the term of this patent is extended or adjusted under 35 U.S.C. 154(b) by 243 days.

(21) Appl. No.: 09/625,944

(22) Filed: Jul. 26, 2000

(30) Foreign Application Priority Data

Jul. 27, 1999 (JP) ..... P11-212857

(51) Int. Cl.[7] ..... H04R 11/04
(52) U.S. Cl. ..... 381/362; 381/367; 181/20
(58) Field of Search ..... 381/362, 364, 381/367, 370, 374, 375, 376, 381, 382, FOR 147, FOR 148, FOR 149, FOR 150; 181/18, 20, 22, 128

(56) References Cited

U.S. PATENT DOCUMENTS 2,485,405 A * 10/1949 Olney et al. ..... 181/22
4,917,504 A * 4/1990 Scott et al. ..... 381/187
4,926,961 A * 5/1990 Gattey et al. ..... 181/22
5,298,692 A 3/1994 Ikeda et al. ..... 181/135
5,446,788 A 8/1995 Lucey et al. ..... 379/430

FOREIGN PATENT DOCUMENTS

| | | | | |
|---|---|---|---|---|
| GB | 1377237 | * | 9/1972 | ..... H04M/1/05 |
| TW | 346302 | | 11/1998 | |
| TW | 354697 | | 3/1999 | ..... H04R/5/027 |
| TW | 383158 | | 2/2000 | ..... H04R/5/00 |

* cited by examiner

*Primary Examiner*—Curtis Kuntz
*Assistant Examiner*—Brian Ensey
(74) *Attorney, Agent, or Firm*—Jay H. Maioli

(57) ABSTRACT

A microphone which has a highly reliable microphone arm, can be reduced in weight and size, and is constituted by a pipe microphone for narration having good acoustic characteristics includes a voice receiving opening formed in the distal end portion of a hollow microphone arm extending from a microphone main body and having flexibility, a microphone unit arranged in the microphone main body, a ventilation hole formed in the microphone arm on the microphone main body side, wherein the ventilation hole is clogged with an unwoven fabric serving as a ventilation resistance member.

4 Claims, 7 Drawing Sheets

MICROPHONE

BACKGROUND OF THE INVENTION

1. Field of the Invention

The present invention relates to a microphone of a pipe microphone for narration and, more particularly, to a microphone in which a voice receiving opening is formed at the distal end portion of a microphone arm, and a microphone unit is arranged on the attachment proximal side of the microphone arm, so that a light weight, a small size, and an improvement in acoustic characteristic can be achieved.

2. Description of the Prior Art

Various pipe microphones for narration of this type are conventionally provided. In general, a pipe microphone for narration is held on the head of a speaker by a holding mechanism such as a head band, a microphone unit serving as a voice receiver is arranged at the distal end portion of a microphone arm extending from the holding mechanism to the mouth of the speaker.

However, in the pipe microphone for narration described above, a cable drawn from the microphone unit must be wired in the microphone arm to be connected to the holding mechanism. For this reason, with respect to a means for shielding the cable wired in the microphone arm and bending strength against disconnection, the reliability of the microphone arm cannot be achieved, disadvantageously.

In addition, in order to support the weights of the microphone unit and the microphone arm, the microphone arm itself and the holding mechanism must be made strong. For this reason, the whole pipe microphone increases in weight and size, and reductions in weight and size are limited to certain levels.

SUMMARY OF THE INVENTION

The present invention has been made to solve the above problems, and has as its object to obtain a microphone which is constituted by a pipe microphone for narration having good acoustic characteristics and which has a microphone arm whose reliability is improved to make it possible to reduce the microphone in weight and size.

In order to achieve the above object, according to the present invention, there is provided a microphone wherein a voice receiving opening is formed in the distal end portion of a hollow microphone arm section extending from a holding mechanism to the mouth of a speaker, and a microphone unit is arranged on a holding mechanism side of the microphone arm section.

According to the microphone arranged as described above, a voice received from the voice receiving opening of the distal end portion of the microphone arm section is guided in the hollow microphone arm section to be input to the microphone unit on the holding mechanism side. Therefore, since no cable is wired in the microphone arm section, a means for shielding the cable and the bending strength of the microphone arm section need not be considered, and a highly reliable microphone can be achieved.

DETAILED DESCRIPTION OF THE PREFERRED EMBODIMENT

An embodiment of a microphone according to the present invention will be described below with reference to the accompanying drawings while exemplifying a pipe microphone for narration integrated with an earphone.

Figure 1:
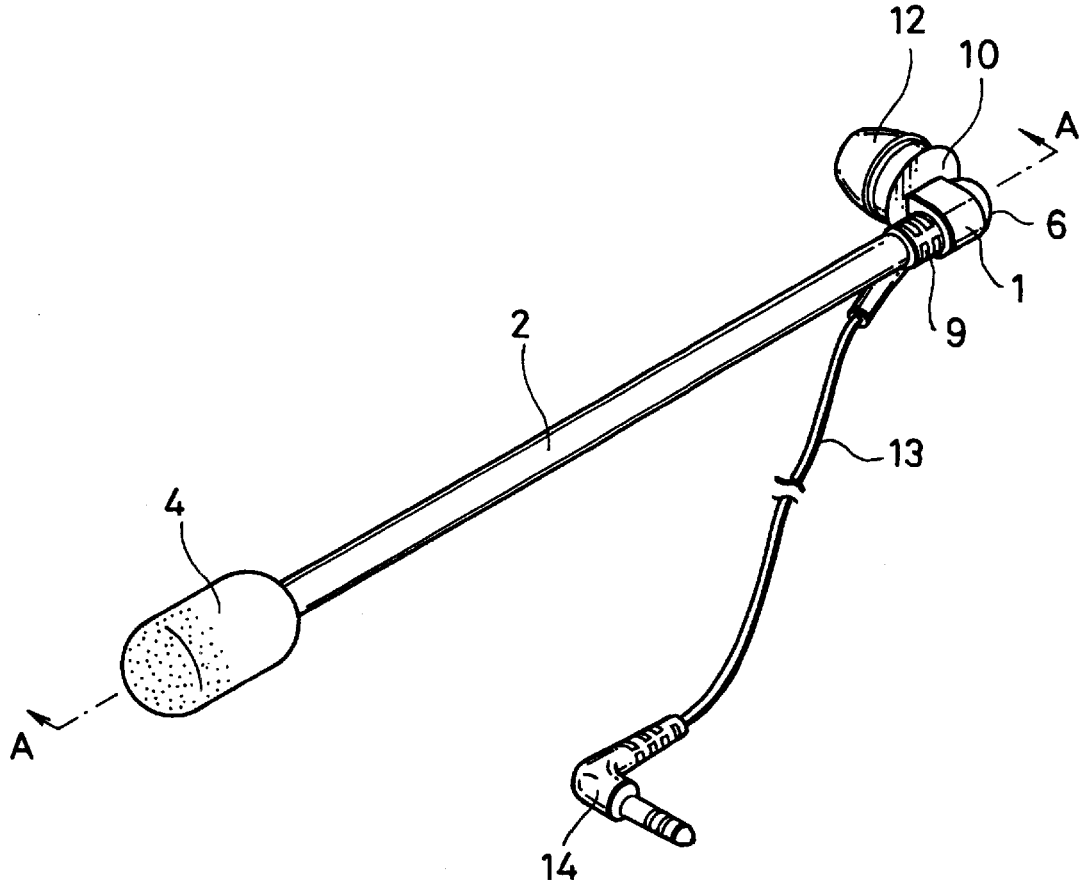
FIG. 1 is a perspective view of an ear set obtained by integrating a pipe microphone for narration according to the present invention with an earphone.
Figure 2:
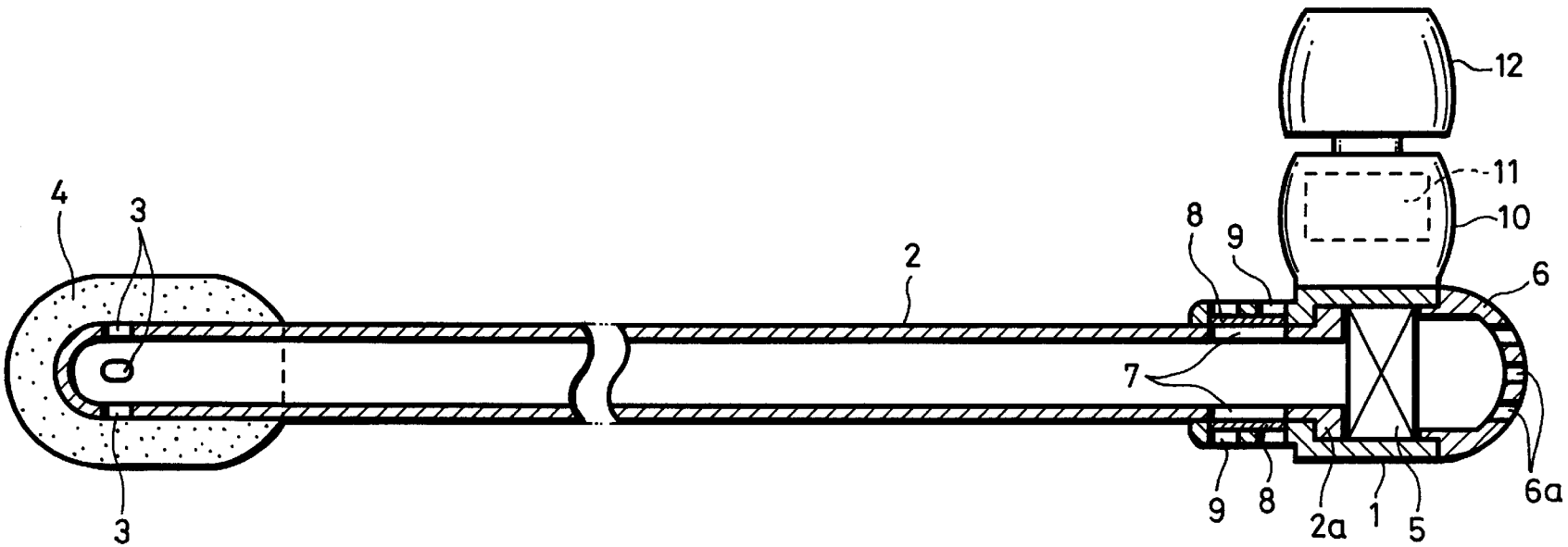
FIG. 2 is an enlarged sectional view along an A—A line in FIG. 1.
Figure 3:
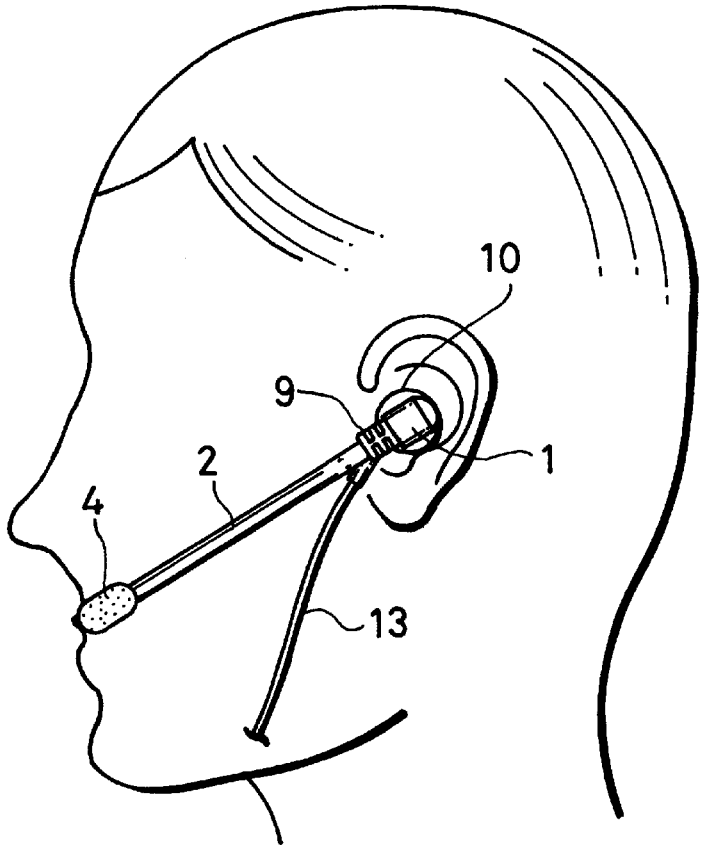
FIG. 3 is an apparent view of a usage state of the ear set.

FIG. 1 is an apparent perspective view of a whole pipe microphone for narration integrated with an earphone, FIG. 2 is an enlarged sectional view along an A-A line in FIG. 1, and FIG. 3 is an apparent view of a usage state.

In a microphone main body 1, a hollow (like a straight tube) microphone arm 2 is inserted, and a flange portion 2*a* formed on an arm proximal end portion is connected to the microphone main body 1 to be fitted thereon. The microphone arm 2 consists of an elastic material such as a soft gum material or a soft resin having flexibility and shape memory properties. For example, the length of the microphone arm 2 is set to be about 100 mm. When the microphone arm 2 is excessively short, an S/N ratio decreases. For this reason, the length of the microphone arm 2 set to be a predetermined length or more.

On the other hand, the distal end portion of the microphone arm 2 is clogged. However, a plurality of voice receiving openings 3 are formed in a peripheral surface near the distal end portion, and a voice of the speaker is guided from the voice receiving openings 3 into the microphone arm 2. A wind screen 4 consisting of, e.g., a sponge material is fitted on the voice receiving openings 3. Although the wind screen 4 need not be fitted, when the voice receiving openings 3 generates noise due to wind, the influence of the wind can be canceled by fitting the wind screen 4.

Here, a microphone unit 5 of the pipe microphone for narration is stored in the microphone main body 1 from the rear end thereof such that the voice receiver is pointed at the microphone arm 2, and a microphone main body 1 is closed with a cap 6 having a hole 6*a* for ventilation. More specifically, a voice guided from the voice receiving openings 3 into the microphone arm 2 is input to the microphone unit 5 through the interior of the microphone arm 2.

In addition, a plurality of ventilation holes 7 are formed in the microphone arm 2 on the microphone main body 1 side. The ventilation holes 7 are covered with, e.g., an unwoven fabric 8 serving as a ventilation resistance member, and window holes 9 are formed in the microphone main body 1 to communicate with the ventilation holes 7 through the unwoven fabric 8.

The pipe microphone for narration described above constitutes a so-called ear set such that the microphone main body 1 is integrated with the earphone main body 10. A loudspeaker unit 11 is incorporated in the earphone main body 10, and the earphone main body 10 has an ear pad 12. The wires extending from the microphone unit 5 and the loudspeaker unit 11 are drawn through a cord 13 to be connected to a plug 14.

According to the ear set arranged as described above, the ear pad 12 of the earphone is fitted on an ear of the speaker, and the wind screen 4 covering the voice receiving openings 3 formed in the distal end portion of the microphone arm 2 of the pipe microphone for narration can be positioned at the mouth of the speaker. More specifically, a voice guided from the voice receiving openings 3 into the microphone arm 2 through the wind screen 4 is input as a voice signal to the microphone unit 5 stored in the microphone main body 1 through the interior of the microphone arm 2.

Figure 4A:
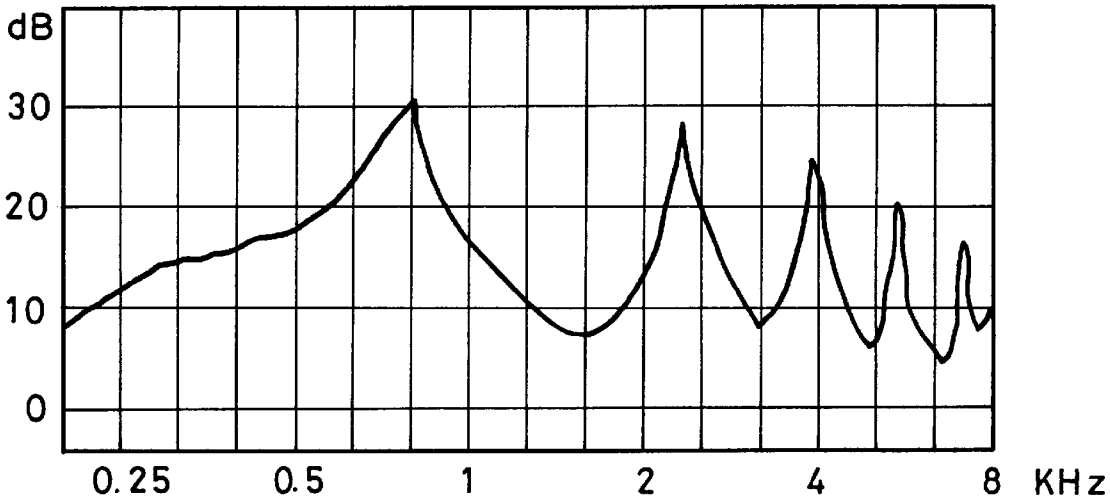
FIG. 4*a* is an acoustic graph obtained when a ventilation resistor is not arranged in the microphone arm.

Here, it is known that the voice moving in the microphone arm 2 generates a high resonant frequency Q in the microphone arm 2 itself to deterioriorate acoustic characteristics. For example, when the unwoven fabric 8 as a ventilation resistance member is not arranged on the ventilation holes 7 of the microphone arm 2, as is apparent from the acoustic characteristics shown in FIG. 4*a*, a plurality of high peaks regularly appear due to the resonance of the microphone arm 2.

In contrast to this, as in the invention shown in FIG. 2, when the ventilation holes 7 are formed in the microphone arm 2, and the unwoven fabric 8 is arranged on the ventilation hole 7 as a ventilation resistance member, the resonant frequency Q of the microphone arm 2 can be decreased. The acoustic characteristics obtained at this time is shown in FIG. 4*b*.

Figure 4B:
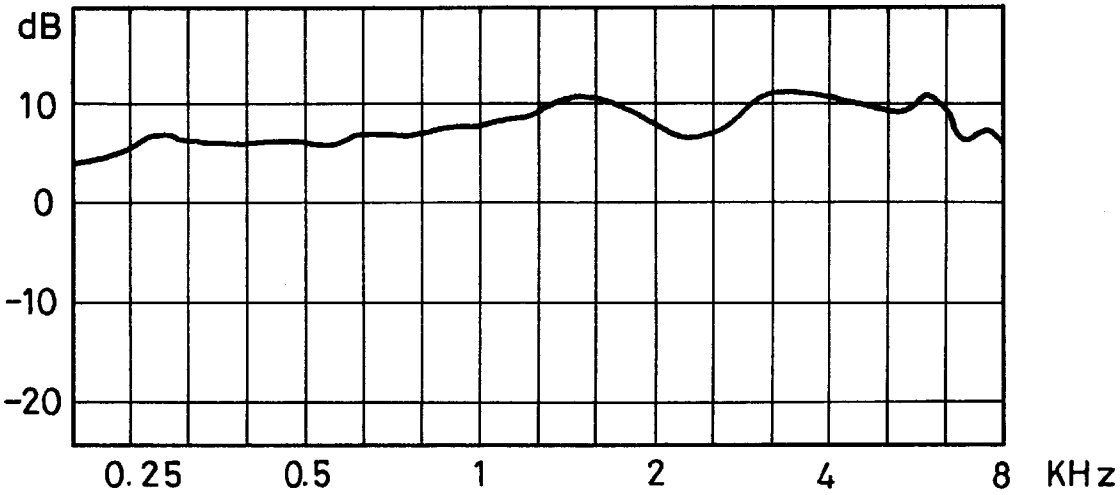
FIG. 4*b* is an acoustic graph obtained when a ventilation resistor is arranged in the microphone arm.

According to this, in the acoustic characteristics shown in FIG. 4*b*, although sensitivity slightly decreases, appropriate articulation can be obtained at intermediate and high frequencies. The articulation is generally increased such that the sound pressure of sound in a range of frequencies 1.5 KHz to 5.0 KHz is increased by several dB. In this manner, when the microphone arm 2 arranged according to the present invention is used, ideal acoustic characteristics can be realized.

The unwoven fabric 8 serving as a ventilation resistance member is stuck on the ventilation hole 7 formed in the microphone arm 2 to be fixed, the same operation as described above can be obtained. In addition, any other material having appropriate ventilation resistance than the unwoven fabric 8 may be used.

Furthermore, the microphone arm 2 consists of an elastic material such as a gum material or a resin material having flexibility, and a simple configuration in which the voice receiving openings 3 are formed in the distal end portion of the microphone arm 2 is used. For this reason, the weight of the microphone arm 2 itself can be reduced, and a mechanism for supporting the microphone arm 2 can be simplified. Therefore, the whole pipe microphone for narration can be reduced in weight and size.

In addition, the microphone arm 2 is curved when a hand or the like touches the microphone arm 2, and, thereafter, the microphone arm 2 reruns to the original position. For this reason, the microphone arm 2 can be conveniently handed, and a contact sound generated when a hand or the like touches the microphone arm 2 is not transmitted to the microphone unit 5 as an impact sound.

Since the microphone unit 5 is arranged in the microphone main body 1 serving as the proximal end portion of the microphone arm 2, unlike a conventional configuration, a cable is wired in the microphone arm 2. Therefore, a means for shielding a cable need not be made, and a highly reliable pipe microphone for narration is achieved.

Figure 5:
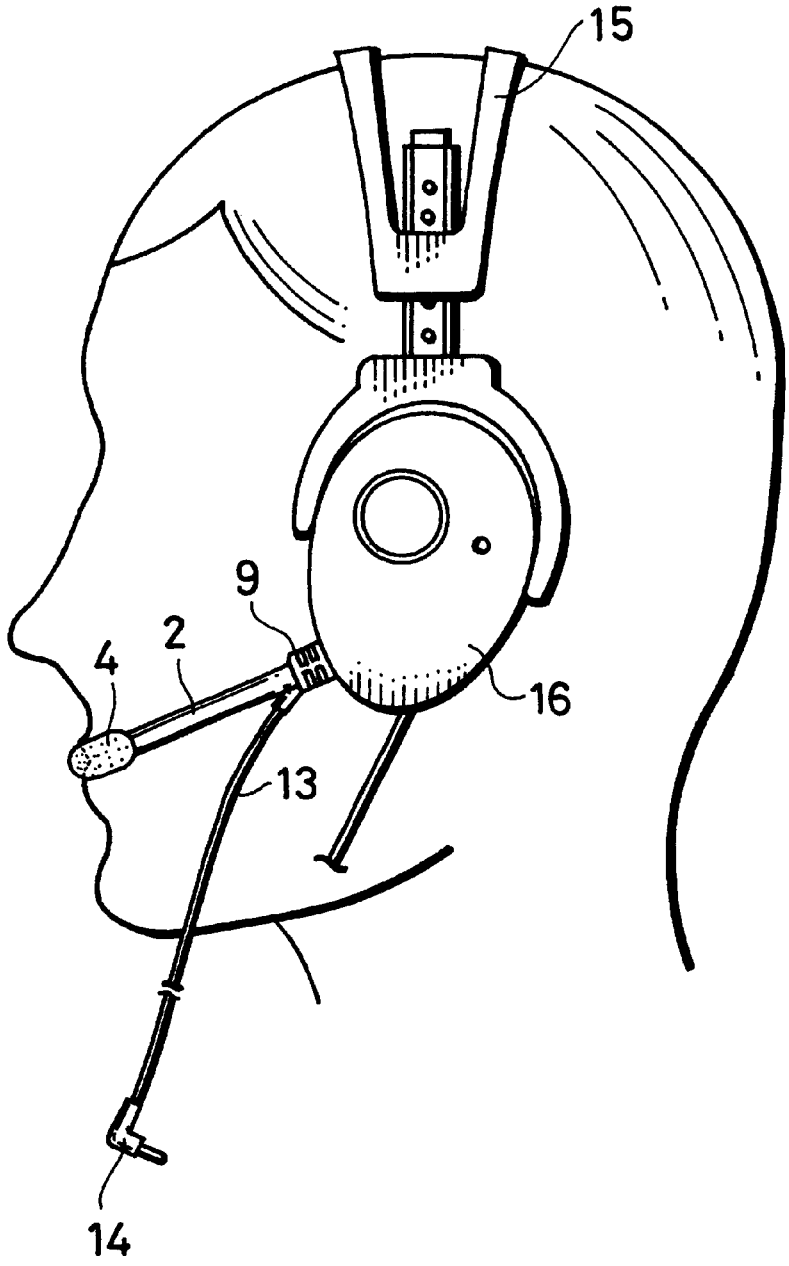
FIG. 5 is a perspective view of a head set obtained by integrating a pipe microphone for narration with a headphone.

A pipe microphone for narration according to the present invention which is not integrated with an earphone is used as a so-called head set such that the pipe microphone for narration is integrated with a headphone housing 16 having a head band 15 as shown in FIG. 5. In this case, the microphone unit 5 is incorporated in the headphone housing 16.

Figure 6:
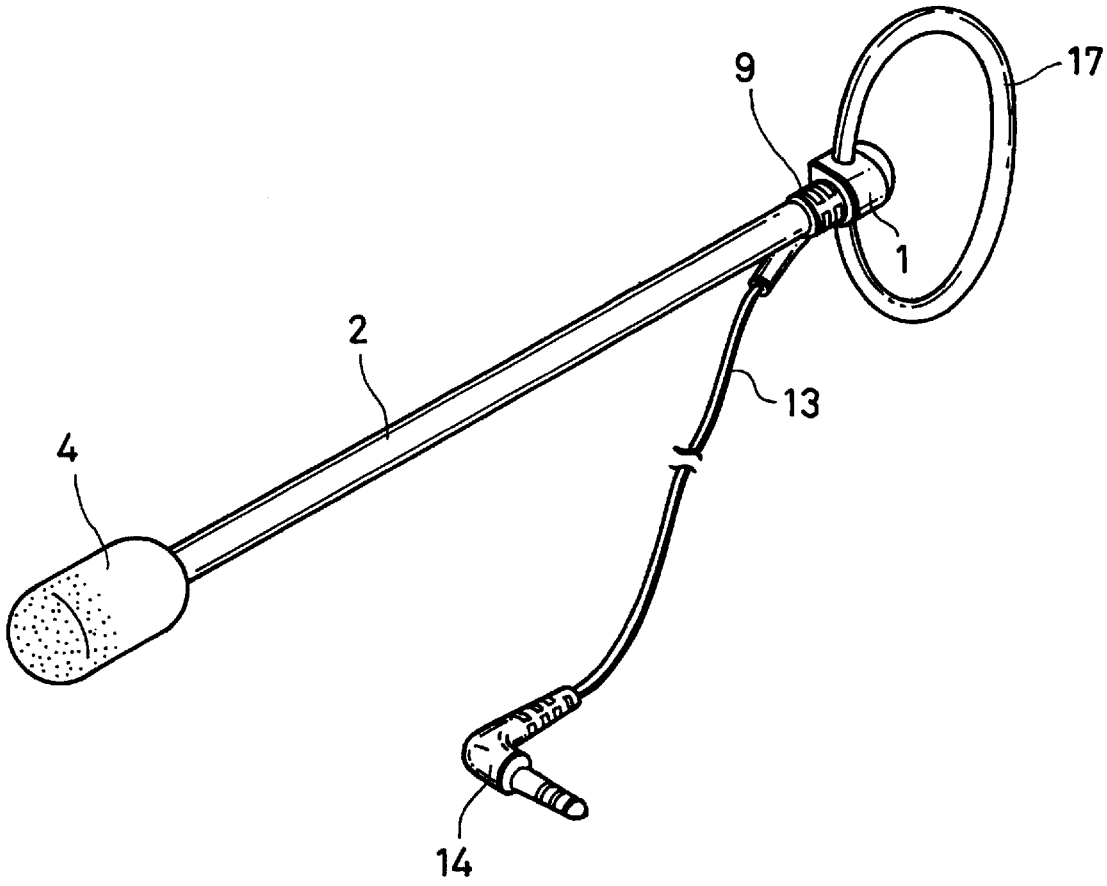
FIG. 6 is a perspective view showing a case in which a pipe microphone for narration is used as an ear-hook microphone.

As shown in FIG. 6, the pipe microphone for narration can be used as an ear-hook microphone in which an annular extendable ear-hook portion 17 is attached to the microphone main body 1 to be fixed to an ear of a speaker.

Figure 7:
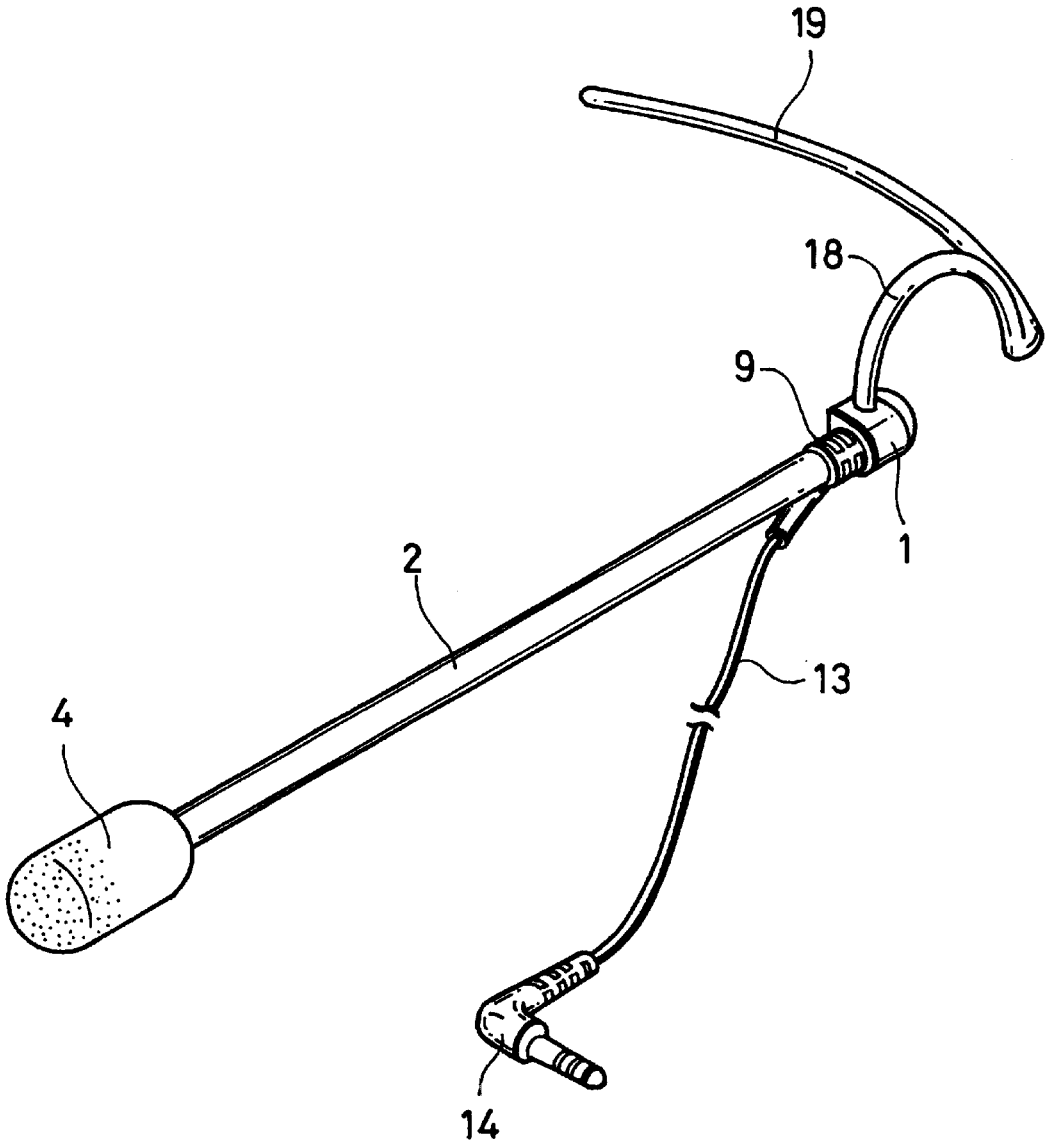
FIG. 7 is a perspective view showing a case in which a pipe microphone for narration is used as a neck-band microphone.

As shown in FIG. 7, the pipe microphone for narration can also be used as a so-called neck band microphone in which an ear-hook piece 18 and a neck band 19 are attached to the microphone main body 1.

The present invention is not limited to the embodiment described above and illustrated in the drawings. Various changes and modifications of the invention can be effected without departing from the spirit and scope of the invention.

In the above description, the microphone arm 2 is formed like a straight tube. However, the microphone arm 2 may be formed like a curved tube such that the voice receiving openings of the distal end portion of the microphone arm 2 are close to the mouth of a speaker in the usage state of the pipe microphone for narration.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A microphone for use by a speaker comprising:

a hollow microphone arm section having a length so that the hollow microphone arm section extends from a holding mechanism to the mouth of the speaker;

a voice receiving opening formed in a distal end portion of the hollow microphone arm section;

a microphone unit arranged on a holding mechanism side of the hollow microphone arm section;

a ventilation hole formed in a portion of the hollow microphone arm section; and a ventilation resistance member arranged to clog the ventilation hole.

2. The microphone according to claim 1, wherein the hollow microphone arm section is formed of an elastic material having flexibility.

3. The microphone according to claim 1, wherein the ventilation resistance member is formed of an unwoven fabric.

4. The microphone according to claim 1, wherein the microphone is a pipe microphone for narration, and is integrated with one of an earphone main body and a headphone main body which forms the holding mechanism.

* * * * *